US005284332A

United States Patent [19]

DiTullio

[11] Patent Number: 5,284,332

[45] Date of Patent: Feb. 8, 1994

[54] REDUCED AERODYNAMIC DRAG BASEBALL BAT

[75] Inventor: Jeffrey C. DiTullio, Stoneham, Mass.

[73] Assignee: Massachusetts Institute of Technology, Cambridge, Mass.

[21] Appl. No.: 949,613

[22] Filed: Sep. 23, 1992

[51] Int. Cl.[5] ..... A63B 59/06

[52] U.S. Cl. ..... 273/72 R; 273/72 A

[58] Field of Search ..... 273/72, 67, 266, 81 B, 273/167 E

[56] References Cited

U.S. PATENT DOCUMENTS

| | | | |
|---|---|---|---|
| 771,247 | 10/1904 | Hillerich . | |
| 1,530,427 | 3/1925 | Simon | 273/72 R |
| 2,169,774 | 8/1939 | Taylor | 273/72 R |
| 4,763,900 | 8/1988 | Carr | 273/72 R |

OTHER PUBLICATIONS

Robert K. Adair, *The Physics of Baseball,* Harper & Row, New York, N.Y., pp. 78–106 (1990).

R. W. Fox and A. T. McDonald, *Introduction to Fluid Mechanics,* pp. 37–44, John Wiley & Sons, Inc., N.Y., N.Y. (1973).

*Primary Examiner*—Mark S. Graham

*Attorney, Agent, or Firm*—Steven J. Weissburg

[57] ABSTRACT

The invention is a baseball bat having a handle portion and an end portion, the end portion having a generally cylindrical surface, and a striking portion, the surface of the striking portion impressed with a plurality of shallow depressions. The depressions are sized and located so as to increase the turbulence of the boundary layer of air flowing over the bat, as compared to the turbulence that would arise under identical conditions due to flow of air over a substantially smooth surfaced control bat, so as to trip the boundary layer and reduce the drag coefficient experienced by the bat, as compared to the drag coefficient that would be experienced by said control bat. Suggested parameters for optimization of the dimple sizes are provided.

17 Claims, 6 Drawing Sheets

REDUCED AERODYNAMIC DRAG BASEBALL BAT

The present invention relates generally to the design of a baseball bat, and more particularly to a baseball bat having advantageous reduced aerodynamic drag properties.

BACKGROUND OF THE INVENTION

The game of baseball is well-known and well loved in the United States, Japan and other parts of the world. A principal object in playing the game is to strike a thrown ball with a bat, to direct the ball to a place in the playing field where the ball will not be caught or easily played. Another object is to hit the ball so far that it leaves the boundaries of the playing field, for a "home run." In the baseball variant of "hardball", the ball is relatively small, on the order of three inches in diameter, and can be thrown relatively fast, with the best professional pitchers achieving speeds of over 100 miles per hour, and good amateurs achieving lower, but still high speeds. Many pitchers are also able to impart initial conditions to the ball as thrown, so that its trajectory departs significantly from a straight line, thereby adding to the difficulty in striking the ball cleanly.

Conventional bats, with which a batter must strike a ball, are typically made of wood, such as ash or, less often, hickory. The bat is typically tapered, having a fat end of no more than two and three-quarters inches in diameter, tapering down gradually to about one and one-quarter inches at the handle. A professional, official hardball bat typically weighs between thirty-one and thirty-six ounces and is less than forty-two inches in length.

Another well known variant of baseball is known as "softball," because the ball that is used is softer and larger than a baseball, having a diameter on the order of four and one half inches. Recreational softball is typically pitched underhand, so the ball travels more slowly than in hardball. However, fast pitch softball pitchers can achieve speeds on the order of the speeds attained by professional baseball pitchers. Because the distance between the softball pitching mound and the batter is only two-thirds that of professional hardball the time for a batter to target a fast pitched softball may be even less than that for a professional baseball batter Needless to say, the small size of the ball, the high speed at which it is pitched, the potential irregular trajectory, and the relatively small size of the bat all contribute to the difficulty in striking the ball cleanly, and directing it to an advantageous location in the playing field. Even the best professional baseball players seldom have successful batting averages of over 0.350, with the vast majority of players hitting at below 0.300.

Many approaches have been proposed and some have been implemented to improve the batter's chances of striking the ball cleanly. For instance, bats have been proposed having textured surfaces that ostensibly improve the likelihood that a ball that is struck off-center will, nevertheless, land in the playing field, rather than going outside of the playing field, for a "foul" ball. For instance, U.S. Pat. No. 771,247, issued in 1904 to J. A. Hillerich, discloses a bat having a striking surface with fish scale-type wedged points, arranged so that if a ball is hit squarely, the flat portion of a fish scale wedge impacts the ball, while, if the ball is hit glancingly, the point of a fish scale impacts the ball. Impact with the point of the fish scale is supposed to grip the ball more closely to the center of the bat, minimizing the likelihood of a foul hit.

U.S. Pat. No. 1,530,427, issued in 1925 to Simon, discloses another bat to reduce the hitting of foul balls. The bat has concavities or indentations in close relation, the depressions "conforming to the surface of the ball" and their outer edges being rounded to prevent injury to the ball when coming in contact therewith. The patent states that the indentations conform approximately to the diameter of the ball, however, what is meant by that statement is unclear. The inventor states that if the ball comes into contact with "some one of the depressions," a foul hit will be prevented.

U.S. Pat. No. 4,763,900, issued in 1988 to Carr, discloses a baseball bat having a striking surface roughened with macroscopic grooves and superimposed microscopic roughening, which are adapted to enhance the tendency of the ball to spin when struck off-center. The spin is intended to enhance the trajectory of the ball.

It is also common for players to use metal bats. The bats are typically aluminum, or an alloy. One advantage of metal bats may be that the ball can be hit farther, due principally to the relatively high elasticity of the metal, as compared to a wooden bat. The result of the collision between the ball and the metal bat is that the bat springs to some extent, and upon relaxation, some of the spring energy is imparted to the ball. Metal bats are also favored because the weight distribution can be adjusted in ways not feasible with a wooden bat, so that more of the weight of the bat is near to the spot where the ball is typically struck. Thus, more of the total momentum in the bat is transferred to the ball. Another very important advantage of metal bats is that they are much more durable than wooden bats, and thus save money for those who use them a great deal.

Metal bats are not currently permitted under the rules of professional baseball in The United States. One reason for this is that the sound that a metal bat makes when it strikes a ball is very different from the sound that a wooden bat makes. The metal bat has a tinny, hollow sound, whereas the wooden bat has a solid, familiar sound. Many participants in the playing and administration of baseball hold as an important objective maintenance of the traditional aspects of the game. One of these traditional aspects is the sound that the ball and bat make upon impact.

Composite bats, for instance of a graphite fiber composition, have also been used, for similar reasons to metal bats. The graphite bat also makes a different sound upon impact with the ball.

For a general discussion of the history of the design of baseball bats, (and other baseball equipment) see Robert K. Adair, *The Physics of Baseball,* Harper & Row, New York, N.Y., pp. 78–106 (1990), which is incorporated herein by reference.

It is desirable to increase the batter's ability to fairly strike a ball, without changing the traditional aspects of the game of baseball, such as the sound that the impact of ball and bat make. Another aspect of baseball that is now traditional, is the opinion that a ball glancingly struck should travel as if it were glancingly struck, i.e. as a foul ball, or a ground ball, or a pop fly. In other words, a player who can strike the ball squarely should have an advantage over one who can not, and the bat should not be designed to minimize this advantage, or equalize two players. However, there is a significant portion of the ball playing community for whom a bat that is easier to swing would be a welcome addition to the game, as long as other traditional features are maintained.

Thus, the several objects of the invention are to provide a ball bat that: is easier to swing than a traditional bat; that, if made from wood, sounds like a traditional wooden bat when striking the ball; that does not affect the trajectory of a ball struck a glancing blow; that does not weaken the physical integrity of a bat; that does not increase the cost of a bat; and that can improve the swingability of wooden, metal and composite bats.

BRIEF DESCRIPTION OF THE INVENTION

In a first preferred embodiment, the invention is a baseball bat having a handle portion and an end portion, the end portion having a generally cylindrical surface, and a striking portion, the surface of the striking portion impressed with a plurality of shallow depressions. The depressions are sized and located so as to increase the turbulence of the boundary layer of air flowing over the bat, as compared to the turbulence that would arise under identical conditions due to flow of air over a substantially smooth surfaced control bat, so as to trip the boundary layer and reduce the drag coefficient experienced by the bat, as compared to the drag coefficient that would be experienced by said control bat. Suggested parameters for optimization of the dimple sizes are provided.

DETAILED DESCRIPTION OF PREFERRED EMBODIMENTS OF THE INVENTION

Figure 1:
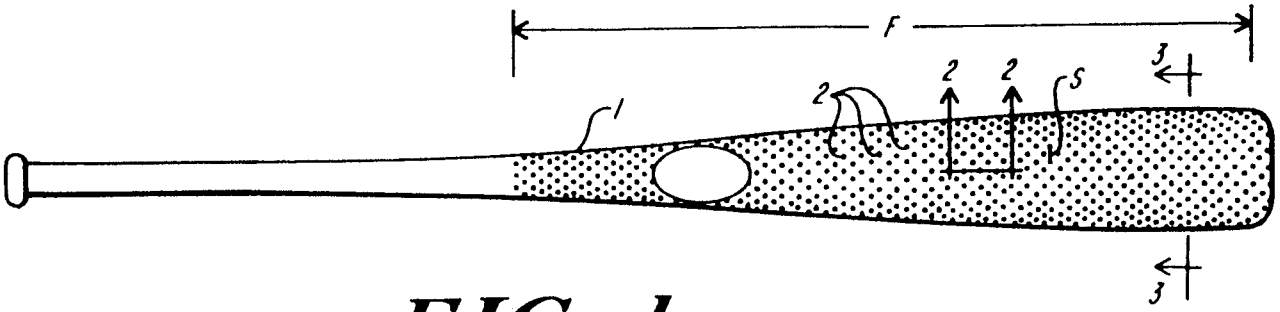
FIG. 1 is a side view of a preferred embodiment of the ball bat of the invention.
Figure 3:
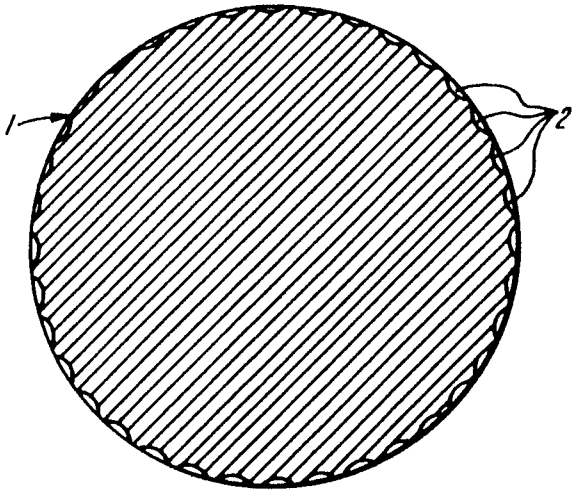
FIG. 3 is an enlarged cross-sectional view on the line B—B of FIG. 1.
Figure 2:
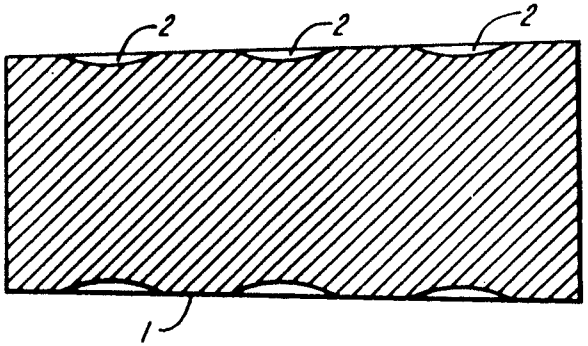
FIG. 2 is an enlarged longitudinal section on the line A—A of FIG. 1.

A preferred embodiment of a bat embodying the invention is shown schematically in FIG. 1. The body 1 of the bat is generally cylindrical in shape, having a circular cross-section. Along the length of the bat, the diameter of the cross-section may vary slightly having its greatest diameter in the region labeled F. The gross dimensions of a bat embodying the invention are the same as the gross dimensions of a typical bat. The diameter in the region F, conventionally known as the "fat" part of the bat, is on the order of between 2.4 and 2.75 inches. The bat can be of the same weight or weight ranges as a typical bat. One of the advantages of the invention is that a batter can generate the same power using a lighter bat of the invention as can be gotten using a conventional heavier bat. In general, the lighter the bat, the more control the batter has with respect to directing the ball to a desired location.

The bat is provided with a plurality of dimples, 2, distributed over its surface generally in the region F, generally about two-thirds of the length from the head of the bat. The dimples are generally round in shape, although this is not required. For a typical bat, the preferred radius of the dimples is on the order of about $11.79 \div \delta_{45°}$ inches in radius (where $\delta_{45°}$ is the thickness of the laminar flow boundary layer at a point $+/-45°$ from the upstream stagnation point around the bat) and their depth is on the order of $1.89 \div \delta_{45°}$ or shallower. A preferred ratio for the radius to the depth is on the order of 6.24. As is explained below, the thickness of the boundary layer varies, depending on the speed of the portion of the bat, which varies depending on the location along the length of the bat, since the free tip of the bat moves faster than the handle end. For a point at the free end of a bat moving at 100 ft/sec (a typical speed for a well-swung bat in professional caliber play), having a diameter of 2.554 inches, the dimple radius is approximately 0.149 inches and the height is approximately 0.024 inches. The same figures for the portion of a bat having a diameter of only 1.72 inches moving at 71.12 ft/sec are 0.145 (radius) and 0.023 (height) respectively.

The dimples are beneficially placed in a general pattern, at a density of about 10 dimples per square inch, with an average distance between dimples of about 0.20–0.25 in., although this is not required. The placement can be generally random.

The dimples provide the advantage of the invention. The dimples reduce the aerodynamic drag between the bat and the air as the bat is swung. Reducing the drag reduces the forces opposing the batter's swing and thus permits the batter to swing the bat faster than if the dimples were not present, assuming that the batter applies the same forces to the bat. A bat swinging faster has more momentum (equal to the product of the mass of the bat and its velocity) which can be transferred to the ball. Thus, more energy will be imparted to the ball, and it will go farther, or faster than otherwise.

Another advantage that the bat of the invention provides is that, rather than swinging a bat of the same weight faster, a batter can produce the same power as would be produced by a heavy bat, by using a lighter bat. The batter has more control directing the path of a lighter bat than a heavier bat, because it takes less force to accelerate the bat. Thus, a batter would have a better chance of causing the bat to meet a ball traveling in a curving pattern with a light bat than with a heavier bat. However, since the bat is moving faster, it can have as much momentum as the heavier bat, and thus the same amount of momentum can be transferred to the ball. Thus, the batter need not sacrifice power for added control, as would be necessary without the invention.

Yet another advantage is due to the fact that because the bat will swing faster than a conventional bat, the batter can wait longer before initiating the swing. Thus, the batter has more time to observe the path of the pitched ball (often far from a straight line or a regular trajectory) and thus, again, a better chance of striking the ball as desired.

Figure 4A:
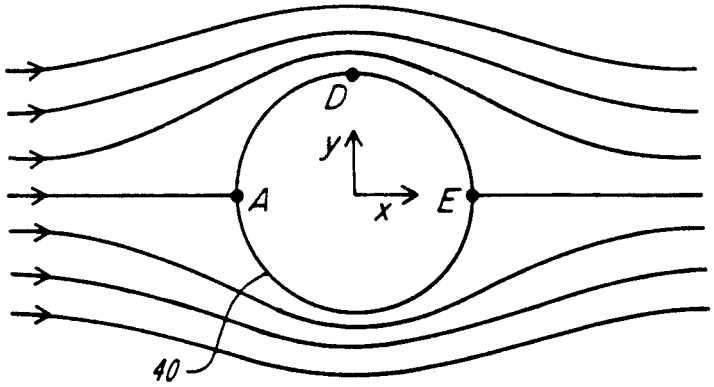
FIG. 4*a* is a schematic view showing the flow of an inviscid fluid around a cylinder.

The principals by which the invention provides these advantages are aerodynamic, illustrated with respect to FIGS. 4*a*, 4*b*, 5, 6 and 7*a* and 7*b*. The following general principals are taken from the discussion in R. W. Fox and A. T. McDonald, *Introduction to Fluid Mechanics*, pp. 37–44, John Wiley & Sons, Inc., N.Y., N.Y. (1973), which is incorporated herein by reference. FIG. 4*a* shows schematically an object 40, such as a baseball bat, with a flow field for a fluid, such as air, flowing around the object. With a baseball bat, the bat appears to an observer to be moving through a stationary fluid. However, the situation is identical to one where the bat is stationary and the fluid flows around it. Because illustration with this situation is more direct, it is used below.

A bat may be classified as a "blunt" object. Blunt objects are those, such as cylinders, without long, tapered tails. (An airplane wing is an example of an object not considered to be "blunt," even though the leading edge of an airplane wing can be in the form of a cylinder.) An ideal case is illustrated in FIG. 4*a*, for an inviscid fluid (i.e. having no viscosity) flowing around a blunt object. According to well known fluid mechanics properties, the velocity of the fluid flowing around the cylinder 40 is zero at point A, increases to a maximum at point D and then decreases further around the cylinder toward E. For inviscid flow, the increase in velocity at point D as compared to points A and E, is accompanied by a decrease in the pressure at point D relative to points A and E. Thus, the pressure along the surface of the cylinder decreases moving from point A to point D, and increases again moving from point D to point E. Since the flow is symmetric with respect to both the x and y axes, the pressure distribution is also symmetric with respect to these axes.

Since inviscid fluid experiences no shear forces between the fluid and the object, the pressure forces are the only forces to consider in determining the net force on the cylinder. The symmetry of the pressure distribution leads to the conclusion that there is no net force on the cylinder in either the x or the y directions. The net force in the x direction (parallel to the flow) is defined as the "drag." Thus, for inviscid flow, the drag is theoretically zero. This conclusion is contrary to experience, because all bodies experience some drag in a real flow. This is because the foregoing rudimentary discussion has ignored the boundary layer that exists in connection with viscous fluids.

Figure 5:
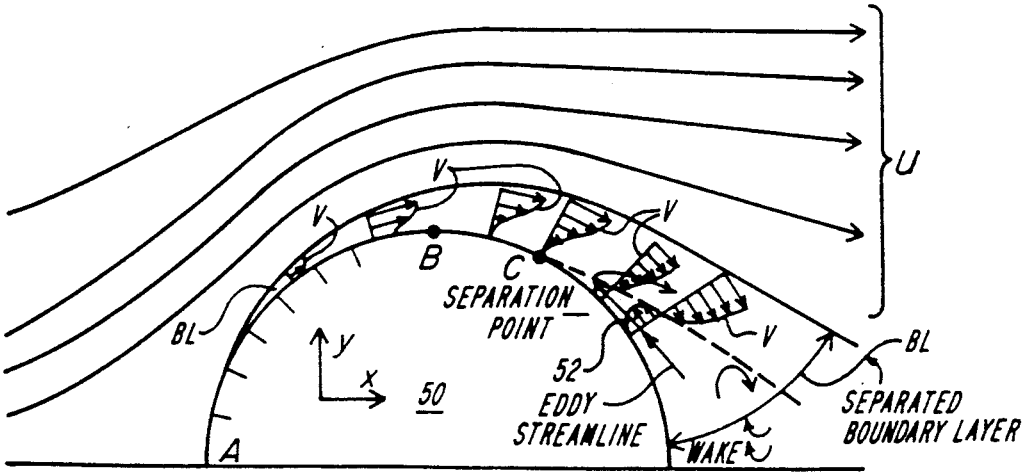
FIG. 5 is a schematic view showing the flow of a viscous fluid over a body, indicating the boundary layer and separation point.

The boundary layer is the portion of the flow field that exhibits the effects of the viscosity of the fluid. As shown in FIG. 5, the boundary layer BL borders the object 50 around which the fluid flows. The boundary layer lies between the object 50 and the uniform flow field U, which flows as if it were inviscid. The demarcation between the boundary layer and the uniform flow field U is not a definite line. Within the boundary layer, the velocity of fluid elements change, both with distance in the direction y away from the object 50, and also with respect to the location in the x direction along the face of the object 50. Typically, the velocity of the fluid right at the face of the body is zero, due to the stickiness of the fluid to the object. Proceeding away from the body, the velocity increases, until it reaches the uniform velocity exhibited in the flow field U. The variation in velocity is indicated schematically by the arrows V in FIG. 5. Typically, the velocity distribution of fluid within the boundary layer is different at points A, B and C, as is indicated by the different sizes of the arrows V in the boundary layers at those respective points.

Figure 4B:
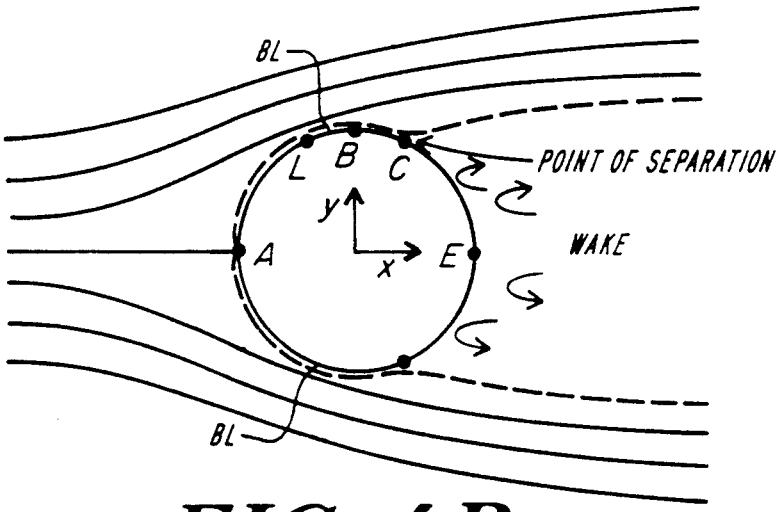
FIG. 4*b* is a schematic view showing the flow of a viscous fluid around a cylinder.

Inviscid flow was considered above with respect to FIG. 4*a*. A more realistic flow is illustrated by FIG. 4*b*, having a thin boundary layer BL. The behavior of the velocity and pressure fields outside the boundary layer is appropriately modeled as the same as in inviscid flow. For a fluid element inside the boundary layer at a position between points A and B, the pressure decreases continuously between points A and B. The fluid element experiences a net pressure force in the direction of fluid flow, i.e. to the right as shown. Over most of the region between A and B, the net pressure force is sufficient to overcome the resisting shear force resultant from the stationary body, and the fluid element moves forward.

For an element of fluid inside the boundary layer at a location on the downstream side of the cylinder beyond point B, the pressure increases in the direction of flow and the fluid element experiences a net pressure force in a direction opposite to its direction of motion. At some point around the cylinder, the momentum of the fluid in the boundary layer is insufficient to carry the element into the downstream region of higher pressure. The fluid layers adjacent to the solid surface are brought to rest. As shown in FIG. 5, not only does part of the flow come to rest, but the increasing pressure downstream of the object can actually cause the stalled flow to reverse direction and flow back along the cylinder surface, as indicated at 52, where the vectors V are pointing generally upstream. This region of reverse flow represents the region where the boundary layer is said to be "separated" from the object. The initial point for separation is indicated at C in FIG. 5 and FIG. 4*a*. Boundary layer separation results in the formation of a relatively low pressure region downstream of a body. The regions exhibiting reverse eddies and a deficiency of fluid momentum downstream is called the "wake," also indicated in FIG. 4*b* and 5.

Thus, for separated flow over a body, there is a net unbalance of pressure forces in the direction of flow. This results in a pressure drag on the body tending to move the body in the direction of fluid flow. The greater the size of the wake behind a body, the greater the pressure drag. It is important to note that the pressure drag is different from drag on the body exhibited by shear forces between the moving fluid and the stationary object. These shear forces also contribute to the total drag, but differ from the pressure drag. With blunt objects, the pressure drag associated with flow separation is many times greater than the shear drag, and accounts for a large percentage of the total drag on blunt bodies. In the case of a stationary fluid and a moving object, such as a baseball bat, the pressure drag tends to resist the motion of the bat, applied by the batter.

The separated boundary layer and the wake displace the outside streamline pattern, which causes the pressure distribution to be significantly altered. The wake represents a continual dissipation of mechanical kinetic energy (manifest in the relative motion between the fluid and the object) into eddying motion also known as "turbulence."

The classification of fluid flow as "turbulent" means that the fluid does not flow in layers. In laminar flow, the fluid flows in layers. The non-layered flow in turbulent flow is due to small velocity fluctuations superimposed on the mean motion of flow. Whether or not flow will become turbulent depends on several factors, including the characteristic size of the object D, the relative velocity between the fluid and the object V and the kinematic viscosity of the fluid, which is related to the viscosity $\mu$ and the density $\rho$ of the fluid. These parameters can be related through a dimensionless constant known as the Reynolds number R.

$$R=\rho DV/\mu.$$

The onset of turbulence is by degree, typically occurring within a range of Reynolds number, with fully laminar flow existing somewhat below the range, and fully turbulent flow existing somewhat above the range.

Turbulence affects the location of boundary layer separation point. The turbulent boundary layer profile is much fuller than the laminar profile. By fuller, it is meant that at locations near to the stationary object over which the fluid flows, the velocity of the fluid is faster in the turbulent boundary layer than it is in the laminar boundary layer. This is because the mixing effect of the turbulent layer mixes the high energy free-stream flow with the low speed, low energy flow near the object surface. Thus, the turbulent boundary layer has considerably more momentum than a laminar boundary layer. Consequently the turbulent boundary layer can penetrate farther downstream against an increasing pressure resistance without a fluid element being reversed in direction. Thus a turbulent boundary layer's separation point occurs considerably downstream from that of the laminar boundary layer.

Experimental data suggests that laminar boundary layer separation occurs at about 80 degrees (point L, FIG. 4*b*) from the front stagnation point and turbulent boundary layer separation at about 125 degrees (point C, FIG. 4*b* and 5). The wake region for the turbulent boundary layer is considerably smaller than for the laminar boundary layer. This, along with the later separation point, results in greater pressure recovery on the back side of the cylinder and a net reduction in drag. Thus, increasing turbulence can decrease drag because the boundary layer separation point is further downstream, thereby resulting in a smaller wake region.

Figure 6:
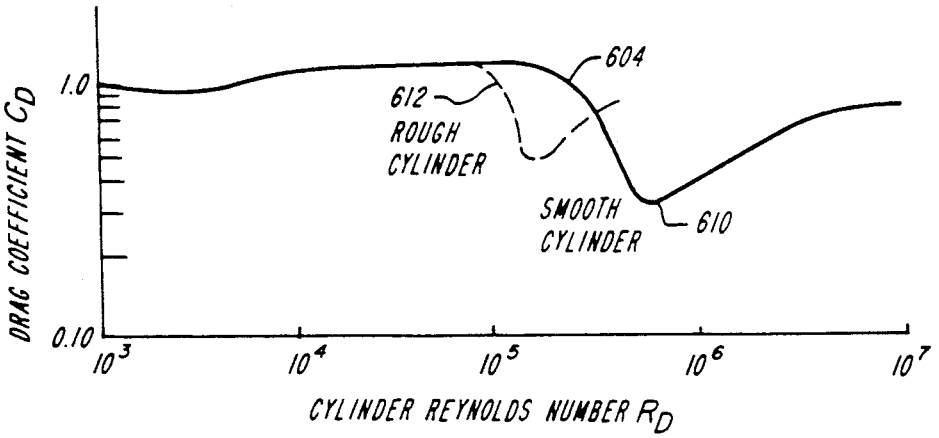
FIG. 6 shows schematically the relation between the drag coefficient and Reynolds number for smooth and rough cylinders.

This relationship is shown graphically with respect to FIG. 6, showing the relationship between the drag coefficient $C_D$ (vertical scale) and Reynolds number (horizontal logarithmic scale) for a cylinder. Reynolds number can be increased by increasing the relative velocity between the fluid and the object, or by increasing the characteristic size of the object or the density of the fluid. It can also be increased by decreasing the viscosity of the fluid.

The solid curve represents the relationship for a smooth cylinder. In the region for Reynolds number roughly half-way between $10^5$ and $10^6$ (equivalent to between 200,000 and 300,000), the drag coefficient $C_D$ drops severely. This is analogous to the observation that increased turbulence decreases drag, because increased Reynolds number indicates an increased turbulence.

For smooth cylinders with Reynolds numbers of about 200,000 the boundary layer is completely laminar and separates near point L, about 80 degrees back from the stagnation point. As the Reynolds number increases above 200,000, turbulence develops in the boundary layer and the separation point moves back along the cylinder surface. The decreasing region of separated flow results in a dramatic decrease in the drag coefficient indicated at 604 in FIG. 6. Finally, when the boundary flow is fully turbulent, the separation point stops moving back, stopping around point C. The drag coefficient now begins to increase slowly with increasing Reynolds number due to increasing turbulent skin-friction drag. This is indicated at point 610 in FIG. 6. The Reynolds number for the flow over a conventional baseball bat when swung at competitive speeds is approximately 135,000, which is slightly lower than the minimum number of about 200,000 needed to take advantage of the step decrease in drag coefficient $C_d$.

The invention takes advantage of the fact that a cylinder containing surface discontinuities or surface roughness stimulates the onset of boundary layer turbulence at a lower Reynolds number than for a smooth surface. (This early stimulation of boundary layer turbulence resulting in reduced drag coefficient is referred to as "tripping" the boundary layer.) The boundary layer separates farther downstream resulting in greater pressure recovery on the downstream surface and a net drag reduction as compared to the case for the smooth cylinder having the same dimensions, moving at the same speed relative to a fluid having the same density and viscosity. This is indicated by the dashed curve in FIG. 6, indicating the precipitous drop in drag coefficient at below $10^5$, indicated at 612. Thus, the drag is reduced without the extra energy required to achieve the higher Reynolds number of the smooth cylinder, such as by increasing the relative velocity between the fluid and the cylinder or by increasing the characteristic size of the bat.

The present invention reduces the drag coefficient of a baseball bat by altering the surface roughness of the bat, so that turbulence is initiated at lower velocities than would otherwise be required, thus reducing the pressure component of drag. The bat may be swung at a greater velocity for the same applied force, thereby increasing the momentum imparted to the baseball. Further, the batter is given more time to assess a given pitch.

One way to initiate turbulence would be to provide small protuberances or bumps on the surface of a bat. However, such bumps would alter the flight path of a ball and might also damage the ball. It is an object of the invention not to damage the ball, and not to provide the batter with any unconventional directional control (or lack of control). The present invention initiates turbulence by providing small depressions in the bat, which lower the drag without measurably changing the ball/bat contact conditions.

Figure 7A:
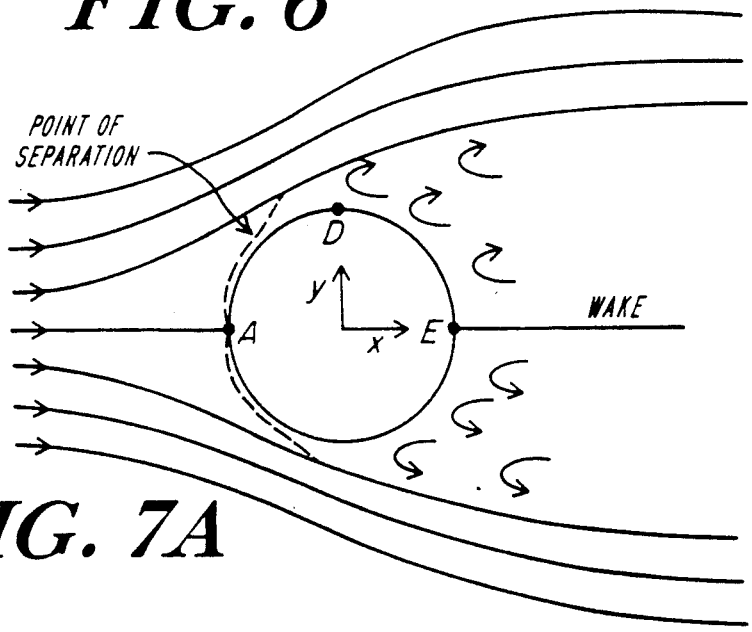
FIG. 7*a* is a schematic view showing the flow of air around a conventional bat.
Figure 7B:
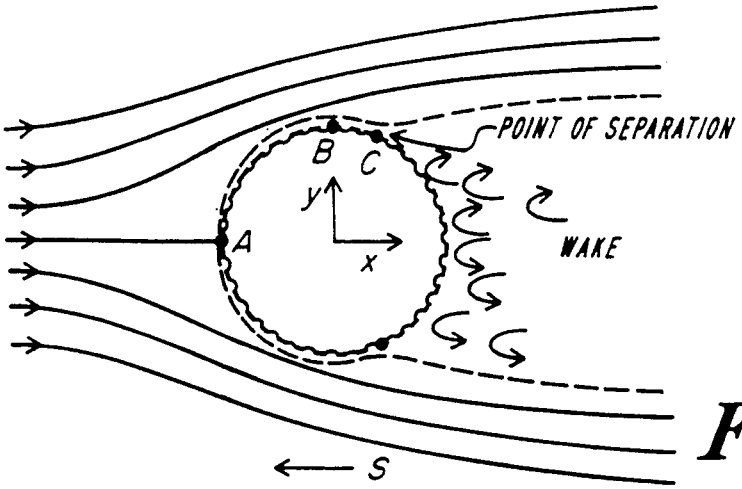
FIG. 7*b* is a schematic view showing the flow of air around a bat embodying the invention.

The effect of application of the invention to a baseball bat is shown schematically in FIG. 7, comparing the flow of air around a conventional bat in FIG. 7*a* and around a bat of the invention, in FIG. 7*b*. As shown in FIG. 7*a*, the separation point is at about 80 degrees around from the stagnation point A, and the turbulent region begins at that point, causing a wide and pronounced wake. Thus, there is a broad region of reduced pressure, and thus a significant pressure drag. As shown in FIG. 7*b*, with a dimpled bat of the invention, the separation point is moved further downstream, approximately 120 degrees from the stagnation point. The wake is narrower, and more confined to the body of the bat. Thus, there is a smaller area of reduced pressure, and thus, less pressure drag on the bat, which is being moved by the batter in the direction indicated by arrow S.

In order to use surface depressions effectively for aerodynamic drag reduction, they must be sized to keep the Reynolds number in the critical range and out of the sub (below ~200,000) and super (above ~800,000) critical ranges, delimited in FIG. 6 by the region between 604 and 610 for a smooth cylinder. For this purpose the size of the surface depressions, or dimples, should theoretically fall within the following ranges, $$2.5 \leqq \frac{r}{\delta_{45°}} \leqq 25.0$$

$$0.5 < \frac{h}{\delta_{45°}} < 5.0$$

$$\frac{r}{h} > \frac{1}{2},$$

where:

r=radius of the dimple;

h=depth of the dimple; and $\delta_{45°}$=Laminar boundary layer thickness for the cylinder at a point +/−45 degrees from the upstream stagnation point for a bat.

These parameters assume that the velocity of the bat to begin with is high enough so that the boundary layer can in fact be "tripped" and the drag coefficient can be reduced by applying depressions. For relatively slow bat velocities, and consequently low Reynolds numbers, the drag coefficient is the same for a smooth and a rough cylinder, so there will be no advantage gained from applying the invention.

The preferred values for the foregoing ratios are:

$$\frac{r}{\delta_{45°}} \approx 11.79$$

$$\frac{h}{\delta_{45°}} \approx 1.89$$

and $$\frac{r}{h} \approx 6.24.$$

Figure 8:
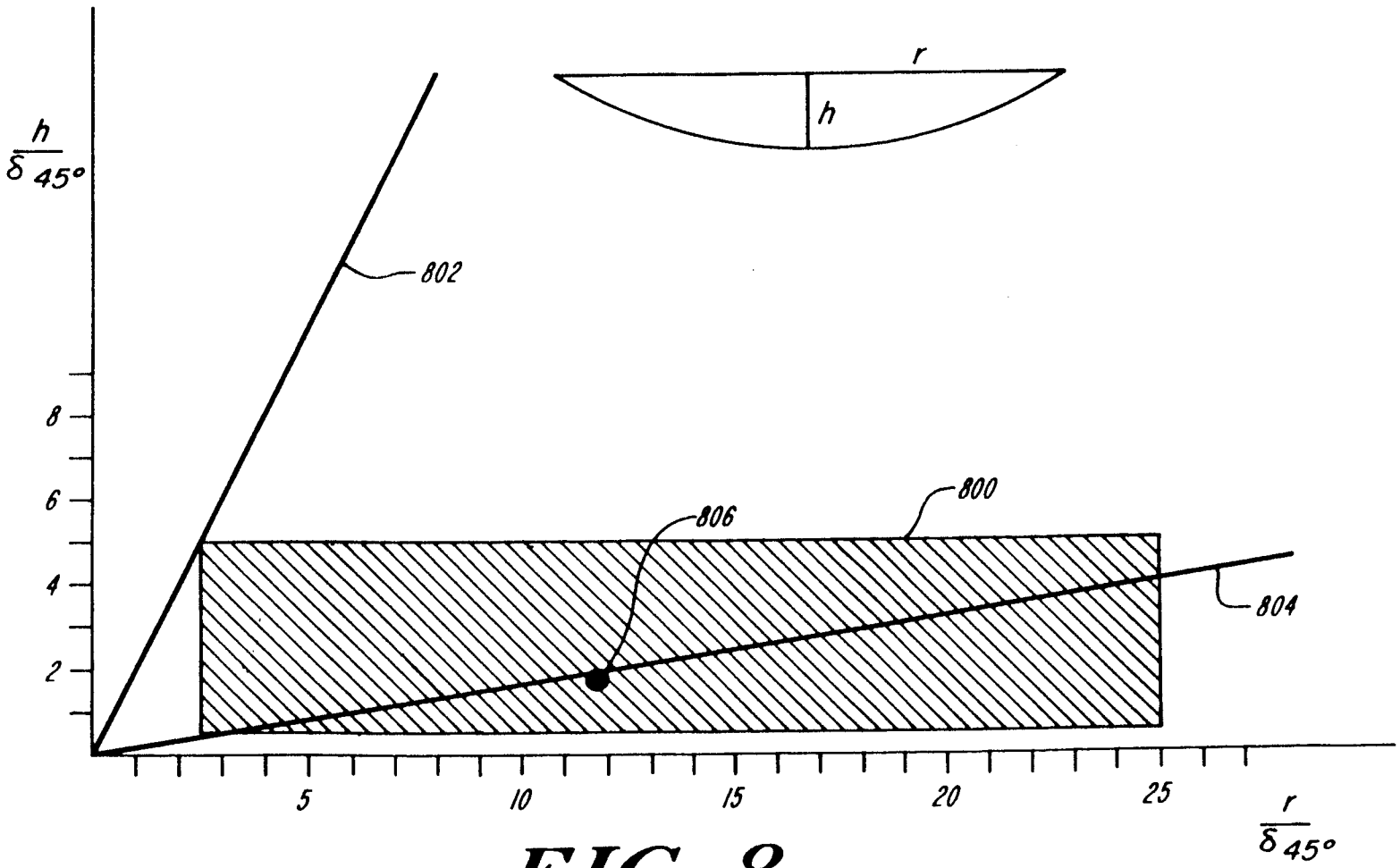
FIG. 8 is a graphical depiction showing the relation between the radius and height of dimples applied to a baseball bat of the invention.

Thus, it can be seen that the dimples should be quite shallow, having an aspect ratio of r/h no less than ½ and preferably much greater. The foregoing set of relationships can be illustrated graphically. As set forth in FIG. 8, $r/\delta_{45°}$ is shown on the horizontal axis and $h/\delta_{45°}$ is shown on the vertical axis. The preferred ranges are bounded within the shaded rectangle 800, bounded between 2.5 and 25 on the horizontal, $r/\delta_{45°}$, axis and 0.5 and 5.0 on the vertical, $h/\delta_{45°}$, axis. The ratio of $$\frac{r}{h} > \frac{1}{2}$$

is illustrated to the right of the line 802. Thus, the region in the shaded box 800 that is to the right of line 802 constitutes the preferred region of combinations of dimple radius, depth and the ratio thereof. The most preferred combinations are those where the ratio r/h=6.24, indicated along line 804. The most preferred combination of $$\frac{h}{\delta_{45°}} \approx 2 \text{ and } \frac{r}{\delta_{45°}} \approx 11.5$$

is indicated at point 806. For purposes of this description, and the claims attached hereto, as used herein, "shallow," when referring to a dimple, shall refer to a dimple having radius and depth such that it lies within the region 800 to the right of line 802. "Very shallow" shall indicate any such dimple whose radius and depth lie within the region 800 on or to the right of and below line 804.

Of course, at some point, as the aspect ratio of the dimples gets too large, they will approach the regular contour of a normal bat, and will no longer cause the desired turbulence.

Figure 9:
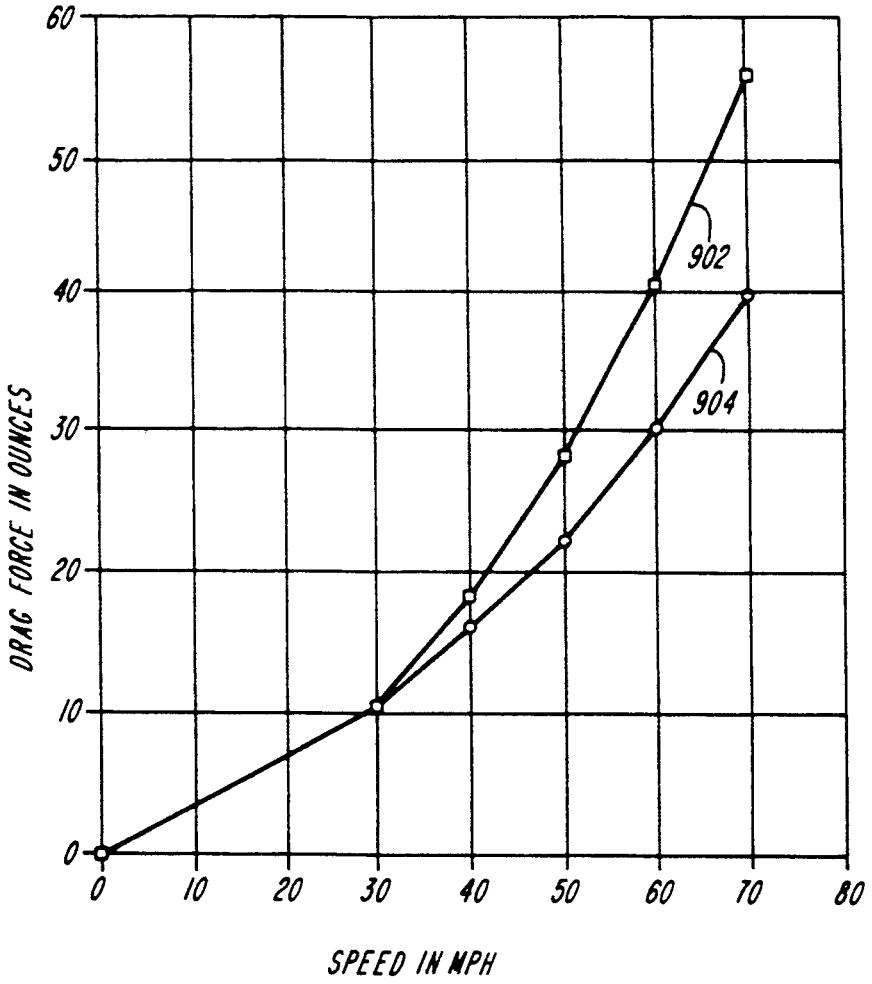
FIG. 9 is a graphical depiction showing the relation between the drag force and the speed of air flowing past a bat, for a bat of the invention and for a bat of the prior art.

The effect of the invention on the drag force experienced by a bat is shown graphically in FIG. 9. Two curves are plotted, relating the drag force experienced by a bat relative (vertical axis) to the relative speed of the bat as compared to the air (horizontal axis). (The graph was made using a wind tunnel, where the bat was maintained stationary, and air was blown past the bat. However, this situation is analogous to one where the air is stationary and the bat moves through the air. One aspect of a swinging bat that differs from a bat simply translating through the air, is that different portions of a bat move at different speeds, depending on their respective locations relative to the center of the bat swing.)

The first curve 902 shows the drag force, in ounces, experienced by a bat of the prior art, without depressions, as compared to the air speed in the wind tunnel in miles per hour. (A quickly moving bat moves at about 100 ft/sec at the fastest moving, free end, which is equivalent to about 68 mile/hour.) The second curve 904 shows the same relation for a bat of the invention, having depressions applied at about 30% smaller in diameter than the preferred sizes, as mentioned above (i.e.

$$\frac{r}{\delta_{45°}} \approx 8$$

and a density of about ten depressions per square in. As can be seen from a comparison of the two curves, the drag force is less for curve 904, for the bat of the invention, particularly at speeds of 40 mph and above.

Figure 10:
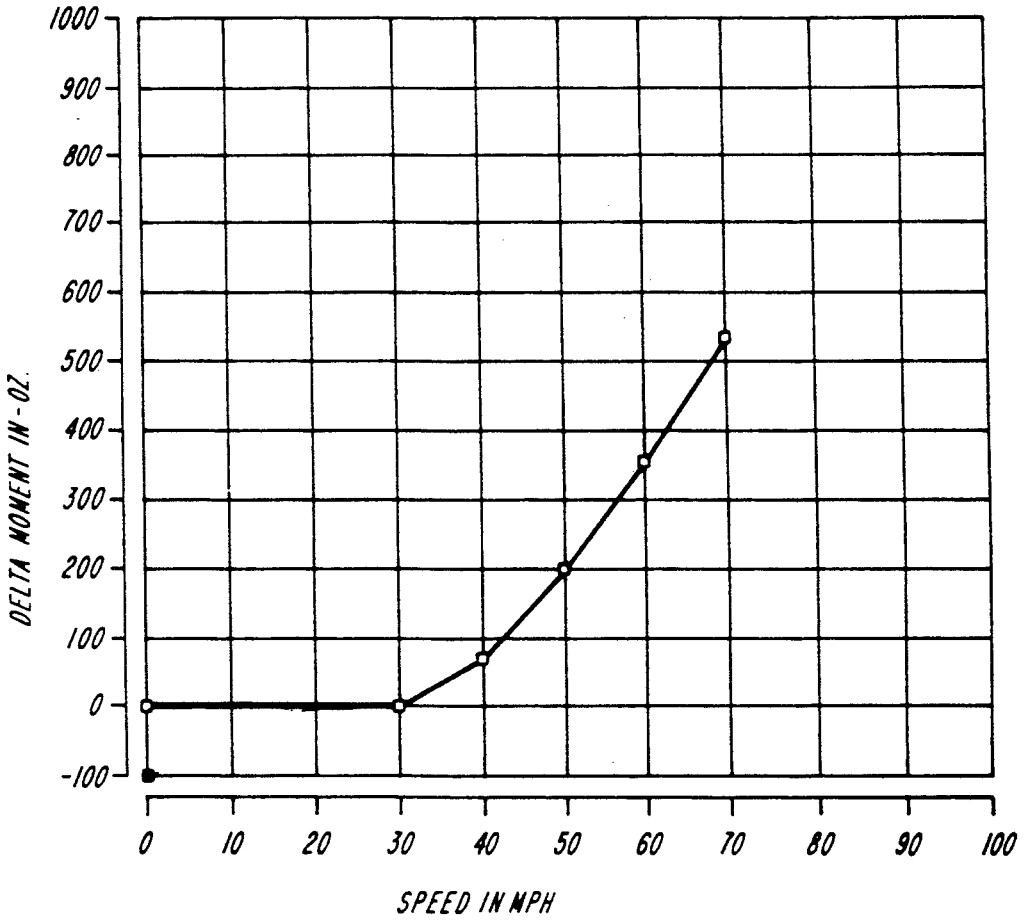
FIG. 10 is a graphical depiction showing the relation between air speed flowing past a bat on the one hand and the difference in aerodynamic moment between a bat of the invention and a bat of the prior art.

The significance of this difference in drag is shown in FIG. 10, which shows the difference in aerodynamic moment (also referred to as "delta moment") for a bat having dimples according to the invention and one having no dimples. The aerodynamic moment is the torque applied to the bat due to the drag, as measured around the batter's hands. The delta moment increases for air speeds exceeding thirty miles per hour. This is significant for two reasons. First, because a bat is of a larger diameter and faster velocity at the free, fat end, this end will experience greater aerodynamic drag than the slower moving, thinner portions of the bat. For the bat of the invention, the difference in drag between these two parts of the bat will be reduced, as compared to a conventional bat. Thus, it will be easier for the batter to swing.

The second reason relates to the way a skilled batter swings a bat. The batter accelerates the bat very quickly at the beginning of the swing. Thus, the batter must apply a force to accelerate the mass of the bat, which is proportional to the mass, the acceleration and the distance of the mass from the batter's hands. As the swing approaches the region where the bat will contact the ball, the bat has reached maximum speed, no longer accelerating as much. Thus, the batter is not applying as much force to overcome inertia, since he is no longer accelerating the bat against its inertia. However, the aerodynamic drag moment still exists, and still opposes the motion of the bat, proportional to the square of the velocity of the bat. Thus, if it is possible to reduce the aerodynamic drag, it is possible to reduce the force that the batter must apply during the crucial contact portion of the swing, where fine control of the bat is most important.

It will be recalled that, for a higher relative velocity, the boundary layer separates further downstream, and thus is thinner at the point +/−45° from the stagnation point, relative to a lower relative velocity. Thus, as between two identical bats, for the faster moving bat, the radius of the holes can be relatively smaller than is necessary for the slower moving bat.

Similarly, between two identical bats, for the faster moving bat, the height or depth of the dimples can be relatively less than is necessary for the slower moving bat.

It will also be understood that for bats of larger diameter, or the portion having the larger diameter, the boundary layer is thicker. Thus, considering bat diameter alone, one would expect the radius of the dimples to be larger at the fatter part of the bat than at the thinner part of the bat. Likewise, the height of the dimples can be expected to be larger at the fatter part of the bat than at the thinner part of the bat.

Because the fatter part of the bat moves more quickly than the thinner part of the bat, it will be understood that the influence of speed and bat diameter oppose one another. Starting with a dimple radius at the fattest, fastest part of the bat, and moving toward a thinner, slower part of the bat, the diminished speed would tend to indicate that the radius of the dimple should be larger, while the diminished diameter of the bat would indicate that the radius should be smaller. Similarly, the indications for dimple height are also opposed.

The foregoing dimple size parameterization is based on the thickness of the laminar boundary layer, which will vary for different velocities. The designer will appreciate that the present invention provides its advantages when the bat is swung at near to the top speeds that the batter can muster. The reduced drag feature is not very beneficial at reduced speeds. Thus, when performing the calculations for dimple size, the designer is advised to assume that the bat will be swung at a typical high speed, for instance with a tip speed of between 80 and 120 feet per second, preferably 100 ft/sec.

The designer will also appreciate that along the length of a bat, the foregoing considerations can be used to size the dimples. In general, a bat is thicker at the free end than at the handle and moves more quickly at the free end than at the handle.

The following table shows the preferred dimple radius and depth in inches for equally spaced points along the length of a bat, having a maximum diameter of 2.554 inches at its free end. The swing radius is the distance from the point to the center of rotation of the bat, which is generally at approximately the batter's elbows, some distance beyond the handle end of the bat. The diameter and height for the depressions at each of the locations is specified. The entries for Reynolds # and $\delta_{45°}$ are for a smooth bat, which has not been modified according to the invention.

TABLE 1

| Swing Radius in. | Bat Diameter in. | Bat Speed ft/sec | Reynolds# (smooth) (Re) | $\delta_{45°}$ (smooth) in. | Dimple radius in. | Dimple height in. |
|---|---|---|---|---|---|---|
| 45 | 2.554 | 100.122 | 135529 | 0.013 | 0.149 | 0.024 |
| 44 | 2.569 | 97.597 | 133296 | 0.013 | 0.151 | 0.024 |
| 43 | 2.553 | 95.672 | 129455 | 0.013 | 0.152 | 0.024 |
| 42 | 2.552 | 93.448 | 126395 | 0.013 | 0.154 | 0.025 |
| 41 | 2.535 | 91.223 | 122564 | 0.013 | 0.156 | 0.025 |
| 40 | 2.491 | 88.998 | 117499 | 0.013 | 0.156 | 0.025 |
| 39 | 2.430 | 86.773 | 111756 | 0.013 | 0.156 | 0.025 |
| 38 | 2.355 | 84.548 | 105530 | 0.013 | 0.156 | 0.025 |
| 37 | 2.282 | 82.323 | 99567 | 0.013 | 0.155 | 0.025 |
| 36 | 2.190 | 80.098 | 92971 | 0.013 | 0.154 | 0.025 |
| 35 | 2.095 | 77.873 | 86467 | 0.013 | 0.153 | 0.024 |
| 34 | 1.955 | 75.648 | 78384 | 0.013 | 0.150 | 0.024 |
| 33 | 1.832 | 73.423 | 71292 | 0.012 | 0.147 | 0.024 |
| 32 | 1.722 | 71.198 | 64980 | 0.012 | 0.145 | 0.023 |
| 31 | 1.608 | 68.973 | 58782 | 0.012 | 0.142 | 0.023 |
| 30 | 1.510 | 66.748 | 53419 | 0.012 | 0.140 | 0.022 |
| 29 | 1.403 | 64.523 | 47979 | 0.012 | 0.138 | 0.022 |
| 28 | 1.312 | 62.298 | 43320 | 0.011 | 0.135 | 0.022 |
| 27 | 1.238 | 60.073 | 39417 | 0.011 | 0.134 | 0.021 |
| 26 | 1.169 | 57.848 | 35841 | 0.011 | 0.133 | 0.021 |

The table shows, as explained above, that the competing influences of the changing bat speed and bat diameter provide for a preferred dimple radius that increases from swing radius 45 to 41, and decreases from 38 to 26. Similarly, the dimple height increases from swing radius 45 to 42, and then decreases from swing radius 35.

As has been explained above, the optimal design would be for the dimples to be sized based on the expected boundary layer thickness at the location along the length of the bat where the dimples are placed. Further, as has been explained, the designer must choose an expected bat speed at which to optimize the dimple size. However, from inspection of Table 1, it can be seen that the variation in dimple height is only four thousandths of an inch. Further, the variation in dimple radius is 23 thousandths. Considering that these depressions would typically be made in a wooden bat, the surface of which is used to strike a ball, it may be that it is more cost effective to simply choose a single size for the dimples, or at least for their depth, and make them uniform. Wood admits of only a certain level of precision in the machining of holes, and further, atmospheric conditions and conditions of use can cause the size of holes that have been applied to change, even on the order of the variations in preferred height. Certainly, advantages of the invention are experienced if all of the dimples are of nominally the same size, chosen from the middle of the ranges of radius and height. For instance, a bat having uniformly sized depressions of 0.023 inches in height and 0.146 inches in radius would provide the advantages of the invention and would be within the scope of the appended claims.

From table 1, even off optimal combinations of depth and height provide for a relatively narrow range of ratios for radius to height. The smallest radius and largest height result in a ratio of 5.32, and the largest radius and smallest height result in a ratio of 7.43.

The dimples can be applied to the bat in any conventional manner. For instance, they can be pressed into the wood using a stationary press, or a rolling press. They can be burned in or grit blasted, if the location and control can be achieved. The dimples need not be circular. If they are not, then the above relationships can be used to size the dimples, with the dimple radius being considered to be the radius of the largest circle that fits inside of the non-circular dimple.

The invention is also advantageously practiced with respect to metal and composite bats. In such a case, the depressions are applied using conventional techniques with respect to the composition. For instance, the metal bats can be formed by a press, or by rolling the dimples into the stock metal before the bat is formed. The composite bats can be formed in molds having the requisite shape to form the dimples.

A bat made according to the invention may also bear the depressions on its free end. Typically, the free end is convex outward (although, some bats have flat, or even concave ends). The depressions can be applied and sized according to the same general principals as obtain with respect to location along the length of the bat. The size and ratio is determined by reference to the boundary layer thickness for flow over the end of the bat, which can be determined by standard techniques. The ratios for the radius and height of the holes would fall in the same ranges as for along the length of the bat.

The size and perimeter shape of the dimples must be such that the trajectory of the ball is not affected by the presence of the dimples. This is in direct contradiction to the teaching of the 1923 patent to Simon discussed above, where the shape and size of the depressions are designed to alter the trajectory of the ball after striking, to minimize the effect of a glancing blow.

Thus, the invention achieves its objects. The invention can be applied to a wooden bat, thereby providing a batter with more power and more control, other factors being equal, while preserving the traditional sound of a wooden bat striking a baseball and the value of striking the ball cleanly. The bats of the invention can be manufactured using conventional techniques, modified only by the steps required to make the dimples. The application of the dimples does not weaken the bat, or markedly change its appearance.

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims. For instance, the dimples can be larger in diameter than shown, as long as they are shallow and within the ranges specified. The pattern or arrangement of the dimples can be any reasonable pattern, as long as the distribution density is sufficient to create the level of turbulence required to take advantage of the drag decrease. The shape of each individual depression can be any shape that will generate turbulence without altering the normal trajectory of a ball that is struck.

Having described the invention, what is claimed is:

1. A baseball bat comprising:

a. a handle portion; and b. an end portion, the end portion having a generally cylindrical surface, and a striking portion, the surface of the striking portion impressed with a plurality of shallow depressions, selected depressions having a radius r sized so that $$2.50 \leqq \frac{r}{\delta_{45°}} \leqq 25.0$$

and a depth h sized so that $$0.5 < \frac{h}{\delta_{45°}} < 5.0,$$

where $\delta_{45°}$ is the laminar boundary layer thickness that would arise around the bat if smooth at a point +/−45° from the upstream stagnation point of air flowing at a speed of between 80 and 120 feet per second around the bat at the location of the respective selected depression.

2. The baseball bat of claim 1; the selected depressions having a radius r sized so that $$5 \leqq \frac{r}{\delta_{45°}} \leqq 12.5.$$

3. The baseball bat of claim 2, the selected depressions having a radius r sized so that $$10.0 \leqq \frac{r}{\delta_{45°}} \leqq 12.0.$$

4. The baseball bat of claim 1, the selected depressions having a depth h sized so that $$1.0 < \frac{h}{\delta_{45°}} < 2.5.$$

5. The baseball bat of claim 4, the selected depressions having a depth h sized so that $$1.5 < \frac{h}{\delta_{45°}} < 2.5.$$

6. The baseball bat of claim 1, the selected depressions further having a radius r sized so that $$\frac{r}{h} > \frac{1}{2}.$$

7. The baseball bat of claim 1, the selected depressions having radius r and depth h sized so that $1<r/h<20$.

8. The baseball bat of claim 1, the selected depressions having radius r and depth h sized so that $5<r/h<15$.

9. The baseball bat of claim 1, the selected depressions having a generally circular edge.

10. The baseball bat of claim 1, the selected depressions further having a radius r sized so that r/h is substantially equal to 6.24.

11. The baseball bat of claim 1, the selected depressions further having a depth h sized so that $h/\delta_{45°}$ is substantially equal to 1.89.

12. The baseball bat of claim 1, the selected depressions further having a depth h sized so that $r/\delta_{45°}$ is substantially equal to 11.79.

13. The baseball bat of claim 11, the selected depressions further having a depth h sized so that $r/\delta_{45°}$ is substantially equal to 11.79.

14. The baseball bat of claim 1, selected of said depressions sized and located so as to increase the turbulence of the boundary layer of air flowing over said bat, as compared to the turbulence that would arise under identical conditions due to flow of air over a substantially smooth surfaced control bat, so as to trip the boundary layer and reduce the drag coefficient experienced by the bat, as compared to the drag coefficient that would be experienced by said control bat.

15. The baseball bat of claim 1, selected of said depressions having a radius r selected from the range between 0.125 inches and 0.170 inches.

16. The baseball bat of claim 1, selected of said depressions having a depth h selected from the range between 0.020 inches and 0.030 inches.

17. The baseball bat of claim 15, selected of said depressions having a depth h selected from the range between 0.020 inches and 0.030 inches.

* * * * *